US005157706A

United States Patent [19]

Hohenauer

[11] Patent Number: 5,157,706

[45] Date of Patent: Oct. 20, 1992

[54] X-RAY TUBE ANODE WITH OXIDE COATING

[75] Inventor: Wolfgang Hohenauer, Kufstein, Austria

[73] Assignee: Schwarzkopf Technologies Corporation, New York, N.Y.

[21] Appl. No.: 795,790

[22] Filed: Nov. 21, 1991

[30] Foreign Application Priority Data

Nov. 30, 1990 [AT] Austria ..... A2421/90

[51] Int. Cl.[5] ..... H01J 35/10

[52] U.S. Cl. ..... 378/144; 378/129

[58] Field of Search ..... 378/129, 143, 144

[56] References Cited

U.S. PATENT DOCUMENTS

| | | | |
|---|---|---|---|
| 3,993,923 | 11/1976 | Magendans et al. | 313/330 |
| 4,029,828 | 6/1977 | Bildstein et al. | 427/34 |
| 4,516,255 | 5/1985 | Petter et al. | 378/143 |
| 4,520,496 | 5/1985 | Schreiber | 378/128 |
| 4,870,672 | 9/1989 | Lindberg | 378/129 |
| 4,953,190 | 8/1990 | Kukoleck et al. | 378/129 |

FOREIGN PATENT DOCUMENTS

| | | |
|---|---|---|
| 0172491 | 2/1986 | European Pat. Off. . |
| 0244776 | 11/1987 | European Pat. Off. . |
| 3226858 | 1/1984 | Fed. Rep. of Germany . |

*Primary Examiner*—Craig E. Church
*Attorney, Agent, or Firm*—Morgan & Finnegan

[57] ABSTRACT

An X-ray anode, in particular a rotary anode, having a parent body made of a carbon-containing refractory material. To improve the thermal radiation characteristics of the anode, the anode is provided with an oxidic top layer outside the focal spot or the focal track regions which contains a homogeneously fused phase. A two-ply interlayer arrangement, containing a first-ply of molybdenum and/or tungsten, and a second oxidic ply of $Al_2O_3$, containing 1-30% by weight of $TiO_2$, is arranged between the parent body and the oxidic top layer. As a result of this interlayer structure, the fusion of the oxidic top layer so as to form a homogeneous phase becomes possible without problems. In addition, the ageing resistance of the thermal emission coefficient ("$\epsilon$") is substantially improved.

24 Claims, 2 Drawing Sheets

X-RAY TUBE ANODE WITH OXIDE COATING

FIELD OF THE INVENTION

The invention relates to an X-ray anode, in particular a rotary anode, of high thermal emissivity, having a carbon-containing parent body made of a refractory metal and also a focal spot region or focal track region made of a refractory metal or its alloys, which anode has an oxidic top layer on at least on parts of the anode surface outside the focal track or focal spot regions, the oxidic top layer containing a homogeneous fused phase.

BACKGROUND

In X-ray tube anodes, only a fraction of the supplied electrical energy is converted into X-ray radiation energy. Most of the energy is converted into undesirable heat, which subjects the anodes to severe temperature stresses.

In the past, there has been no lack of attempts to devise ways to enable rapid removal of the thermal energy produced in X-ray anodes, primarily by seeking to increase thermal emissivity at the anode surface. A known way for increasing the thermal emissivity of X-ray anodes is to deposit oxide coatings onto the anode surface. The oxide coatings typically contain a certain proportion of titanium dioxide, which results in a blackening effect. These oxide top layers are also frequently fused, after their application to the anode, by a thermal treatment, which results in a still improved thermal emission factor and an improved adhesion of the coating layer to the substrate material.

EP-A2 0 172 491 describes an X-ray anode made of a molybdenum alloy, such as the molybdenum alloy TZM, having an oxide coating composed of a mixture of 40–70% titanium dioxide, the remainder being composed of stabilized oxides from the group comprising $ZrO_2$, HfO, MgO, $CeO_2$, $La_2O_3$ and SrO. This prior disclosure describes fusing the oxide coating in order to improve both the thermal emission coefficient and the adhesion of the oxide layer to the parent body. The disadvantage of such an X-ray anode is that the carbon contained in the parent body of the rotary anode brings about a severe ageing of the oxidic top layer, which leads to a premature deterioration of the thermal emission coefficient.

Austrian Patent Specification 376 064 described an X-ray tube rotary anode having a parent body of a carbon-containing molybdenum alloy, for example TZM, which is provided, outside of the focal track region, with a surface coating for improving thermal emissivity that is composed of one or more oxides or of a mixture composed of one or more metals with one or more oxides to improve the thermal emissivity. This prior disclosure proposes arranging a 10–200 μm thick interlayer made of molybdenum and/or tungsten between the parent body and the oxide coating, in order to prevent the rapid ageing of the rotary anode and thus the premature reduction of the thermal emission coefficient. A disadvantage of such a rotary anode is that fused oxide coatings virtually can not be produced. It has been found that, depending on the manner of deposition of the molybdenum and/or tungsten interlayer, the oxidic top layer cannot be caused to fuse at all, or it runs off the surface to be coated during fusion.

SUMMARY OF THE INVENTION

Therefore, the object of the present invention is to provide an X-ray tube anode composed of a carbon-containing parent body and a fused oxidic top layer to increase the thermal emission coefficient of the anode, so that the anode displays a markedly better ageing resistance than the prior art in relation to the thermal emission coefficient, and so that the fusion of the oxidic top layer to form a homogeneous phase is possible without problems.

These and other objects according to the invention are achieved by forming a two ply interlayer arrangement containing, starting from the parent body of the anode, a first ply of molybdenum and/or tungsten, and a second ply of $Al_2O_3$ containing 1–30% by weight of $TiO_2$, which interlayer arrangement is arranged between the parent body of the anode and oxidic top layer.

BRIEF DESCRIPTION OF THE DRAWINGS

The invention will now be described in greater detail by way of reference to the following drawings, in which.

DETAILED DESCRIPTION OF PREFERRED EMBODIMENTS

Figure 1:
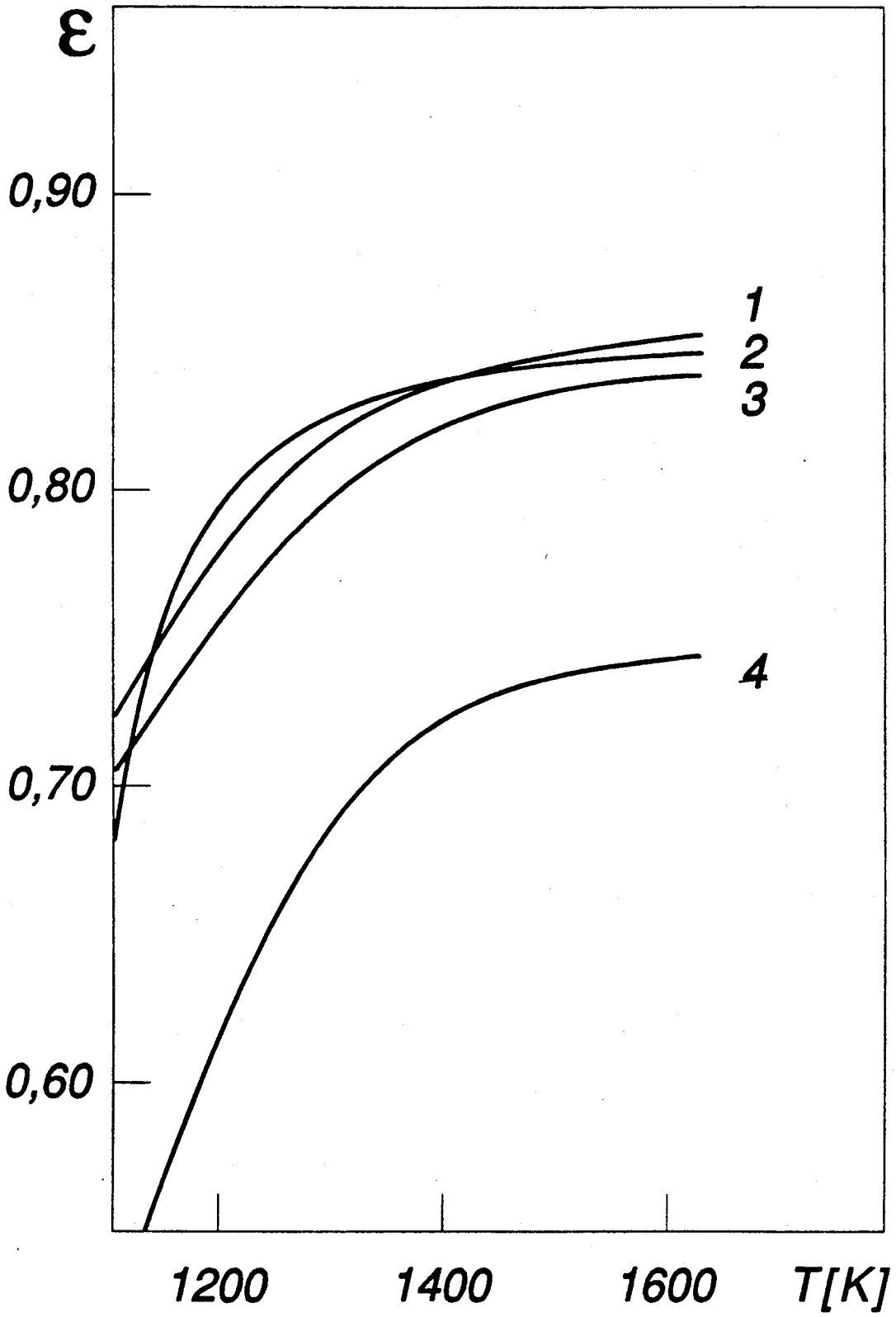
FIG. 1 shows a diagram depicting the temperature dependence of the thermal emission factor "ε" of a rotary anode produced in accordance with Example 1 according to the invention, and also of a corresponding rotary anode formed without interlayer, in each case with and without thermal ageing.

As a result of the special interlayer arrangement, the X-ray anodes according to the invention display a readily fusible oxidic top layer which exhibits excellent adhesion to the parent body. The thermal emission coefficient ("ε") is over 80% for suitable oxide coatings, and deteriorates only to an insignificant extent during the long-term operation of the X-ray anode.

The effect that oxidic top layers can now be fused without difficulty, and do not run off the surface during fusion, that results by supplementing the known interlayer ply composed of molybdenum and/or tungsten with a further oxide interlayer ply composed of a special composition of $Al_2O_3$ and $TiO_2$, cannot be explained ad hoc from the theoretical background.

The deposition processes used for the interlayer arrangement and the oxidic top layer are preferably thermal coating processes, such as, for example, plasma-jet spraying. Other deposition processes, such as PVD and CVD processes, and in particular plasma CVD processes and sputtering processes, have also proved successful.

The best results in relation to fusion properties and ageing resistance are achieved if the oxidic ply of the interlayer arrangement is composed of $Al_2O_3$ containing 5–20% by weight of $TiO_2$, and the total layer thickness of the interlayer arrangement is between 10 and 100 μm.

In particular, mixtures of $ZrO_2$, $TiO_2$ and $Al_2O_3$, and also mixtures of $TiO_2$, $ZrO_2$, $Al_2O_3$ and/or $SiO_2$, in each case with or without stabilizing oxides such as CaO and/or $Y_2O_3$, have proved successful as fused oxidic top layers.

The molybdenum alloy TZM, which typically contains 0.5% Ti, 0.7% Zr and 0–0.05%C, in particular has proven successful as a material for the parent body.

The invention will be explained in greater detail below with reference to examples.

EXAMPLE 1

An X-ray rotary anode composed of the molybdenum alloy TZM has an approximately 2 mm thick W-Re layer in the focal track region. To increase the thermal radiation capability, the anode surface is first provided with an interlayer arrangement according to the invention, followed by an oxidic top layer.

For this purpose, a fully sintered and mechanically reshaped X-ray anode is cleaned and roughened by sandblasting on the rear side of the anode to be coated. As immediately as possible thereafter, the anode is provided with a first interlayer ply of a 20 μm thick molybdenum layer, which is applied by means of plasma-jet spraying under the standard process conditions. This ply is then followed by an annealing treatment carried out under hydrogen atmosphere at approximately 1,350° C. for about two hours. A second interlayer ply of an oxide layer containing 13% by weight of $TiO_2$, the remainder being $Al_2O_3$, is then deposited in a layer thickness of 20 μm, again by plasma-jet spraying. Immediately thereafter, the oxidic top layer is deposited in a layer thickness of 20 μm, likewise by plasma-jet spraying under the standard process conditions. The oxidic top layer has the following composition: 68% by weight of $ZrO_2$, 7.5% by weight of CaO, 19% by weight of $TiO_2$, and also 5.5% by weight of $SiO_2$.

In order to eliminate electrical flashovers as a consequence of the release of gas inclusions during the subsequent use of the rotary anode in the high-vacuum X-ray tube, the coated rotary anode is subjected to an annealing treatment, thereby rendering it useable in X-ray tubes. As a result of the annealing treatment, the rotary anode, and in particular both the parent material and the layer material, is substantially freed of gas inclusions and also of impurities which are volatile at elevated temperatures. This degassing annealing treatment, which is matched to the anode parent material, is carried out within a narrow temperature and time range in order to avoid undesirable structural changes in the parent material. In addition, the applied layer should also be treated within a very specific temperature and time range, depending on its composition, in order that it achieve fusion in the desired homogeneous phase and so that it displays a slightly shrivelled surface structure (i.e., the layer gives the appearance of an "orange-peel").

In the present case, the annealing treatment is carried out at 1,620° C. for 65 minutes. The fused top layer has the desired degree of blackening and also the required surface structure (i.e., the surface structure has the appearance of an "orange peel"). No uncontrolled flow of the fusing oxide layer occurs, in particular not in the transition region between the coated and uncoated parts of the rotary anode surface. Insofar as gaseous oxides evaporate from the layer surface during the annealing process, these do not deposit as a troublesome layer condensation in the originally uncoated focal track region of the rotary anode.

The rotary anode was then tested in an X-ray tube experimental system under realistic conditions. It ran faultlessly there for several days within the required limit loading.

EXAMPLE 2

An X-ray rotary anode composed of a TZM alloy parent body and a 2 mm thick W-Re layer in the focal track region is produced in the same way as the rotary anode in accordance with Example 1, with the exception that the oxidic top layer has the following modified composition: 68% by weight of $ZrO_2$, 7.5% by weight of CaO, 19% by weight of $TiO_2$ and also 5.5% by weight of $Al_2O_3$.

To demonstrate that the interlayer arrangement according to the invention markedly improves the ageing resistance of the thermal emission coefficient compared with rotary anodes without interlayer, a comparison was made between rotary anodes produced in accordance with Examples 1 and 2 and rotary anodes which have the same oxidic top layer but no interlayer arrangement according to the invention. The results of these comparisons, conducted with respect to the thermal emission factor of the respective anodes as a function of temperature and time, appear in FIGS. 1 and 2.

With reference to the FIGURES, in FIG. 1, curve 1 shows the variation in the thermal emission factor ("ε") of a rotary anode produced in accordance with Example 1 as a function of temperature. At this point, the anode has not been subjected to thermal ageing.

Curve 2 shows the corresponding variation of a rotary anode produced in accordance with Example 1, but without the interlayer arrangement according to the invention. This anode too has not yet been subjected to thermal ageing. It can be seen that the variation of curves 1 and 2 is roughly the same.

Curve 3 shows the variation of the thermal emission factor of a rotary anode produced in accordance with Example 1 after thermal ageing. The ageing was carried out by a 10-hour annealing of the rotary anode at a temperature which is above the maximum temperature to which the anode is later subjected to in operation.

Curve 4 shows the corresponding variation of a rotary anode thermally aged as above, but produced in accordance with Example 1 without the interlayer arrangement according to the invention.

In comparing curves 3 and 4, it can be clearly seen that as a result of the interlayer arrangement according to the invention, the thermal emission coefficient of the anode produced with an interlayer arrangement exhibits only a slight deterioration of the thermal emission coefficient, even after being subjected to the effects of long-term stressing. On the other hand, the thermal emission coefficient of the rotary anode produced without an interlayer according to the invention drops significantly.

Figure 2:
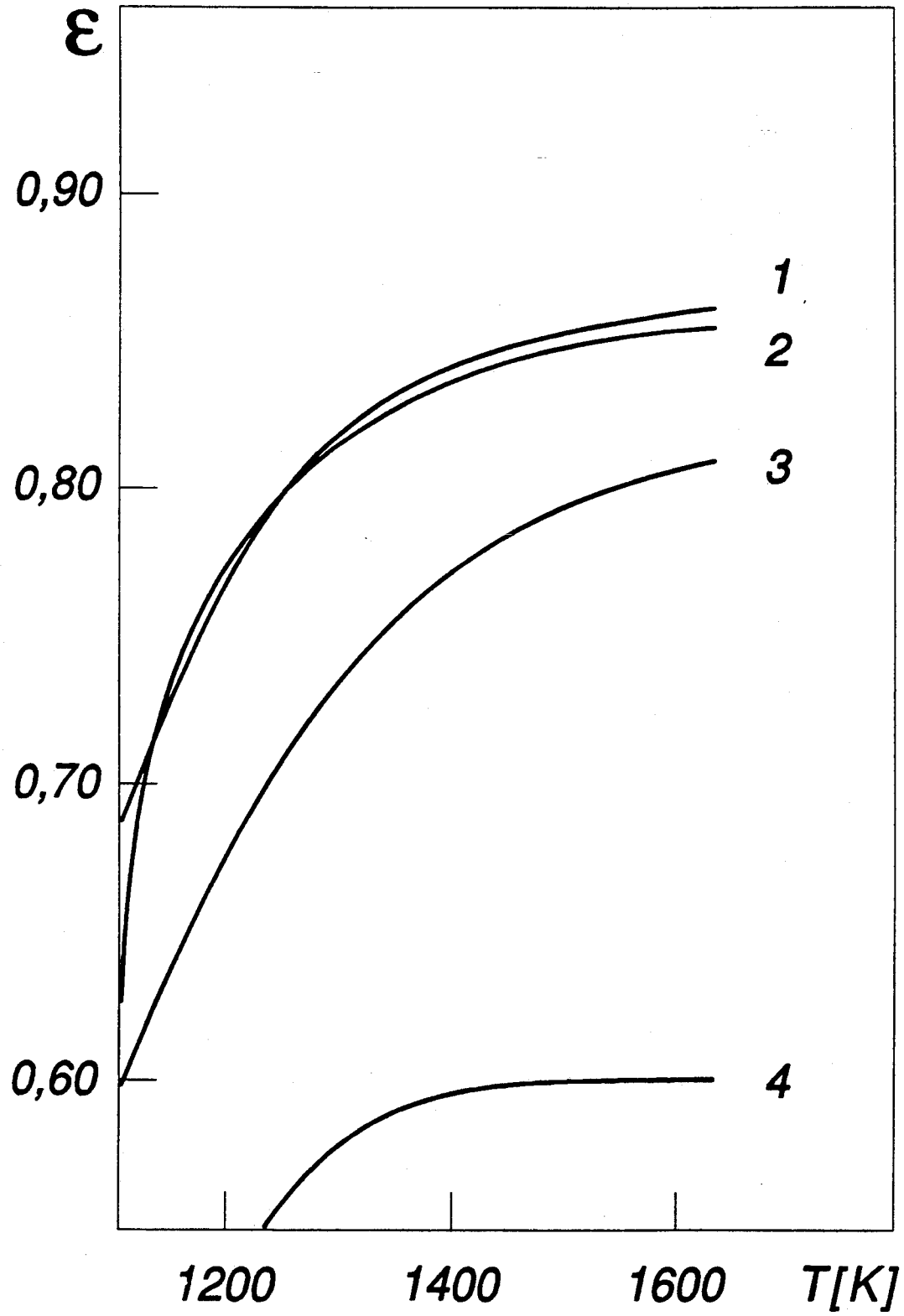
FIG. 2 shows a diagram depicting the temperature dependence of the thermal emission factor "ε" of a rotary anode produced in accordance with Example 2 according to the invention, and also of a corresponding rotary anode formed without interlayer, in each case with and without thermal ageing.

Like FIG. 1, FIG. 2 shows the corresponding curves of rotary anodes produced in accordance with Example 2, with and without an interlayer arrangement, and before and after 10-hour ageing. Curve 1 corresponds to a rotary anode, with interlayer, before ageing; curve 2 corresponds to a rotary anode, without interlayer, before ageing; curve 3 corresponds to a rotary anode, with interlayer, after ageing; and curve 4 corresponds to a rotary anode, without interlayer, after aging. Here again, it can be seen that a substantially improved ageing resistance of the thermal emission factor is achieved as a result of the interlayer arrangement according to the invention.

What is claimed is:

1. An X-ray anode, in particular a rotary anode, of high thermal emissivity, said anode having a carbon-containing parent body made of a refractory material and a focal spot region or focal track region made of a refractory metal or its alloys, said anode having an oxidic top layer at least on parts of the anode surface outside the focal track, said oxidic top layer containing a homogeneous fused phase, wherein a two-ply interlayer arrangement is arranged between said parent body and said oxidic top layer, said two-ply interlayer arrangement comprising, starting from said parent body, a first ply of molybdenum and/or tungsten and a second oxidic ply of $Al_2O_3$ containing 1-30% by weight of $TiO_2$.

2. The X-ray anode as claimed in claim 1, wherein said oxidic ply of said interlayer arrangement comprises $Al_2O_3$ containing between 5-20% by weight of $TiO_2$.

3. The X-ray anode as claimed in claim 1, wherein said interlayer arrangement is between 10 and 100 μm thick.

4. The X-ray anode as claimed in claim 2, wherein said interlayer arrangement is between 10 and 100 μm thick.

5. The X-ray anode as claimed in claim 1, wherein said oxidic top layer comprises a mixture of $ZrO_2$, $TiO_2$ and $Al_2O_3$, optionally with stabilizing oxides such as CaO and/or $Y_2O_3$.

6. The X-ray anode as claimed in claim 2, wherein said oxidic top layer comprises a mixture of $ZrO_2$, $TiO_2$ and $Al_2O_3$, optionally with stabilizing oxides such as CAO and/or $Y_2O_3$.

7. The X-ray anode as claimed in claim 3, wherein said oxidic top layer comprises a mixture of $ZrO_2$, $TiO_2$ and $Al_2O_3$, optionally with stabilizing oxides such as CaO and/or $Y_2O_3$.

8. The X-ray anode as claimed in claim 4, wherein said oxidic top layer comprises a mixture of $ZrO_2$, $TiO_2$ and $Al_2O_3$, optionally with stabilizing oxides such as CaO and/or $Y_2O_3$.

9. The X-ray anode as claimed in claim 1, wherein said oxidic top layer comprises a mixture of $TiO_2$, $ZrO_2$ and $SiO_2$, optionally with stabilizing oxides such as CaO and/or $Y_2O_3$.

10. The X-ray anode as claimed in claim 2, wherein said oxidic top layer comprises a mixture of $TiO_2$, $ZrO_2$ and $SiO_2$, optionally with stabilizing oxides such as CaO and/or $Y_2O_3$.

11. The X-ray anode as claimed in claim 3, wherein said oxidic top layer comprises a mixture of $TiO_2$, $ZrO_2$ and $SiO_2$, optionally with stabilizing oxides such as CaO and/or $Y_2O_3$.

12. The X-ray anode as claimed in claim 4, wherein said oxidic top layer comprises a mixture of $TiO_2$, $ZrO_2$ and $SiO_2$, optionally with stabilizing oxides such as CaO and/or $Y_2O_3$.

13. The X-ray anode as claimed in claim 1, wherein said parent body is composed of TZM.

14. The X-ray anode as claimed in claim 2, wherein said parent body is composed of TZM.

15. The X-ray anode as claimed in claim 3, wherein said parent body is composed of TZM.

16. The X-ray anode as claimed in claim 4, wherein said parent body is composed of TZM.

17. The X-ray anode as claimed in claim 5, wherein said parent body is composed of TZM.

18. The X-ray anode as claimed in claim 6, wherein said parent body is composed of TZM.

19. The X-ray anode as claimed in claim 7, wherein said parent body is composed of TZM.

20. The X-ray anode as claimed in claim 8, wherein said parent body is composed of TZM.

21. The X-ray anode as claimed in claim 9, wherein said parent body is composed of TZM.

22. The X-ray anode as claimed in claim 10, wherein said parent body is composed of TZM.

23. The X-ray anode as claimed in claim 11, wherein said parent body is composed of TZM.

24. The X-ray anode as claimed in claim 12, wherein said parent body is composed of TZM.

* * * * *